US010612855B2

(12) United States Patent
Kolb

(10) Patent No.: US 10,612,855 B2
(45) Date of Patent: Apr. 7, 2020

(54) MODULAR HEAT EXCHANGER ASSEMBLY FOR ULTRA-LARGE RADIATOR APPLICATIONS

(71) Applicant: Enterex America LLC, Westbrook, CT (US)

(72) Inventor: John A. Kolb, Westbrook, CT (US)

(73) Assignee: ENTEREX AMERICA LLC, Westbrook, CT (US)

( * ) Notice: Subject to any disclaimer, the term of this patent is extended or adjusted under 35 U.S.C. 154(b) by 0 days.

(21) Appl. No.: 15/887,056

(22) Filed: Feb. 2, 2018

(65) Prior Publication Data

US 2018/0156542 A1 Jun. 7, 2018

Related U.S. Application Data

(62) Division of application No. 14/846,068, filed on Sep. 4, 2015, now abandoned.

(60) Provisional application No. 62/084,620, filed on Nov. 26, 2014.

(51) Int. Cl.

| | |
|---|---|
| ***F28D 1/04*** | (2006.01) |
| ***F28F 9/00*** | (2006.01) |
| ***F02B 29/04*** | (2006.01) |
| ***F28F 9/02*** | (2006.01) |

(Continued)

(52) U.S. Cl.

CPC ..... *F28D 1/0417* (2013.01); *F02B 29/0412* (2013.01); *F28D 1/0443* (2013.01); *F28F 9/0226* (2013.01); *F28F 9/0236* (2013.01); *F28F 9/04* (2013.01); *F28F 9/06* (2013.01); *F28F 2009/004* (2013.01)

(58) Field of Classification Search

CPC ..... F28D 1/0417; F28D 1/0443; F28F 2009/004; F28F 9/0226; F28F 9/0236; F28F 9/04; F28F 9/06; F02B 29/0412

USPC ..... 165/173

See application file for complete search history.

(56) References Cited

U.S. PATENT DOCUMENTS 911,156 A * 2/1909 Politz ..... F16L 5/10 277/606

1,597,720 A * 8/1926 Carrier ..... F28D 1/05333 165/149

(Continued)

FOREIGN PATENT DOCUMENTS

CN 201229142 Y 4/2009

*Primary Examiner* — Paul Alvare

(74) *Attorney, Agent, or Firm* — DeLio Peterson & Curcio LLC; David R. Pegnataro

(57) ABSTRACT

A modular heat exchanger assembly for ultra-large radiator applications. At least two heat exchanger cores are arranged in parallel flow, each core including inlet and outlet tanks sealingly attached to opposing headers at each end of a plurality of tubes. Each header is formed by securing mating header plates having mating openings. A plurality of O-rings are trapped within O-ring grooves formed by continuous depressions around each of the mating openings, and a portion of each tube is disposed within one of the O-rings and expanded outwardly to form a seal at each tube-to-header joint. A common tank is connected between tanks at adjacent ends of each heat exchanger core, and separate tanks are connected to the tank at the opposing ends of each core. The separate tanks may be inlet tanks and the common tank may be an outlet tank for fluid, or the flow path may be reversed.

13 Claims, 7 Drawing Sheets

(51) Int. Cl.
*F28F 9/04* (2006.01)
*F28F 9/06* (2006.01)

(56) References Cited

U.S. PATENT DOCUMENTS

| | | | | | |
|---|---|---|---|---|---|
| 2,969,956 | A * | 1/1961 | Forgo | F28F 9/06 | 165/175 |
| 3,305,012 | A * | 2/1967 | Allen | F28F 9/06 | 165/178 |
| 3,391,732 | A | 7/1968 | Murray | | |
| 3,447,603 | A | 6/1969 | Jones | | |
| 3,471,178 | A | 10/1969 | Roe | | |
| 3,739,840 | A | 6/1973 | Jones | | |
| 3,857,151 | A | 12/1974 | Young et al. | | |
| 4,122,894 | A * | 10/1978 | Laws | F28F 9/06 | 165/175 |
| 4,191,244 | A | 3/1980 | Keske | | |
| 4,502,297 | A | 3/1985 | Winterer | | |
| 4,542,784 | A | 9/1985 | Welsh | | |
| 4,651,821 | A | 3/1987 | Moranne | | |
| 4,756,361 | A | 7/1988 | Lesage | | |
| 5,205,354 | A | 4/1993 | Lesage | | |
| 5,226,235 | A | 7/1993 | Lesage | | |
| 5,381,858 | A | 1/1995 | Fredrich | | |
| 5,538,079 | A | 7/1996 | Pawlick | | |
| 5,894,649 | A | 4/1999 | Lambert et al. | | |
| 5,901,784 | A | 5/1999 | Potier | | |
| 6,247,232 | B1 | 6/2001 | Lambert et al. | | |
| 6,330,747 | B1 | 12/2001 | Lambert et al. | | |
| 6,460,610 | B2 | 10/2002 | Lambert et al. | | |
| 7,234,511 | B1 | 6/2007 | Lesage | | |
| 7,506,681 | B2 * | 3/2009 | Lesage | B21D 53/085 | 165/69 |
| 8,215,015 | B2 | 7/2012 | Lesage | | |
| 8,296,948 | B2 | 10/2012 | Lesage | | |
| 8,631,859 | B1 | 1/2014 | Hettrich | | |
| 2007/0169926 | A1 | 7/2007 | Watanabe et al. | | |
| 2009/0139474 | A1 * | 6/2009 | Mokire | F02B 29/0456 | 123/41.58 |
| 2010/0252242 | A1 | 10/2010 | Xiangxun et al. | | |
| 2010/0254081 | A1 * | 10/2010 | Koenig | F28D 1/05375 | 361/679.46 |
| 2011/0024037 | A1 | 2/2011 | Becnel et al. | | |
| 2014/0332188 | A1 * | 11/2014 | Chen | F28F 1/42 | 165/109.1 |

* cited by examiner

MODULAR HEAT EXCHANGER ASSEMBLY FOR ULTRA-LARGE RADIATOR APPLICATIONS

RELATED APPLICATIONS

This application claims priority to U.S. Application No. 62/084,620, filed on Nov. 26, 2014.

BACKGROUND OF THE INVENTION

1. Field of the Invention

The present invention relates to heat exchangers and, more particularly, to the field of ultra-large air-cooled heat exchangers used in vehicles or industry, such as engine cooling radiators of the type used to cool the largest Diesel-electric generator sets, giant earth-moving haul trucks used in open-pit mining, and some of the largest Diesel-electric locomotives.

2. Description of Related Art

Engine cooling radiators used with internal combustion engines in vehicles or industry are often quite large. Such radiators can be about 9 feet (2.7 m) high by 9 feet (2.7 m) wide or larger, and are subject to unique problems. Industrial radiators such as these are typically of copper/brass soldered construction, wherein solder-coated brass tubes are pushed through holes in a stack of copper fins, which have been held in the desired spacing in a grooved book jig, to form a core block. The core block is then baked in an oven to solder the tubes to the fins. Following this, the tube ends are inserted into brass headers at each end of the core block and soldered, to form a core. The height of such a core is limited by the ability to push long, thin tubes through the holes in the fins, with 48 in. (1.22 m) being close to a practical maximum. Similarly, the size of a typical book jig limits core widths to about 48 in. (1.22 m). Since it is impossible to form radiator cores with tubes as long as 9 feet (2.7 m), such radiators are made with a multiple of radiator cores joined together with core connecting frames.

To make, for example, a core assembly of overall size 72 in. (1.83 m) by 72 in. (1.83 m), two 36 in. (91 cm) copper/brass core blocks are solder connected side-by-side to a single common header at the top and bottom of the core blocks to produce a first core assembly. A second core assembly is constructed with two additional core bocks and two additional headers. The 36-in. (91 cm) high, 72 in. (1.83 m) wide core assemblies are then joined to a connecting filler frame by bolting, with gaskets between the filler frame and each core header, the gaskets substantially the same as the gasket between the radiator tank and the top header of the upper cores. The headers of the core pairs are bolted, with gaskets, to a steel inlet tank and outlet tank with a core separator strip between the side-by-side cores.

Typically, engine coolant enters the large top tank and flows down through two upper radiator cores in parallel, then through the core connecting frame or frames, and finally through two lower radiator cores in parallel to the bottom outlet tank. The upper and lower radiator cores form a series flow path, that is, coolant flows first through the upper cores and then through the lower cores, with attendant pressure drops. The coolant flow rate needed to cool such large engines is so high that typically the radiators are made many more rows of tubes deep than are needed for cooling, just to be able to pass the high coolant flows without excessive pressure drop.

While stationary generator sets are not subject to transportation shock and vibration, the earth movers and locomotives certainly are. To survive this environment, radiators for such service have included resilient tube-to-header joints, such as Mesabi® grommeted cores (U.S. Pat. No. 3,391,732) and General Electric silicone bonded locomotive radiator headers (U.S. Pat. No. 3,447,603). However, both of these approaches to the problem are very expensive to implement.

Moreover, the cooling systems of some locomotives consist of multiple large radiators which are connected into the system by valving on an "on demand" basis. As a result, when running in cold weather on level grade, only two of up to six available radiators might be connected. Then, when climbing a grade, one or more of the other radiators would be connected in order to handle the cooling load. The result is that some radiators would be lying idle at winter ambient temperatures well below freezing when, suddenly, they would be shocked with hot coolant around 190 degrees Fahrenheit. Such a thermal shock would destroy the average radiator core, therefore resilient tube-to-header joints to absorb the expansion/contraction of the core tubes, or, alternatively, very robust construction of tubes and headers, is essential. Again, both are very expensive.

Therefore, a need exists for changes to ultra-large radiators which would allow the assembled cores to be made only as deep as is necessary for proper cooling without raising pressure drop, which would allow the cores to be made much less expensively. A further need exists for a solution to manufacturing ultra-large radiators which includes resilient tube-to-header joints in a less expensive manner.

SUMMARY OF THE INVENTION

Bearing in mind the problems and deficiencies of the prior art, it is therefore an object of the present invention to provide an improved heat exchanger assembly for ultra-large air-cooled radiators wherein the cores are as efficient or even more so than conventional ultra-large radiator assemblies and can be made less expensively.

It is another object of the present invention to provide an improved heat exchanger assembly whereby the assembled cores are only as deep as is necessary for proper cooling without raising pressure drop.

It is another object of the present invention to provide an improved heat exchanger assembly whereby the coolant flow path is reduced by half, thereby reducing coolant pressure drop and allowing the radiator cores to be made thinner, with fewer of rows deep, for the same coolant pressure drop.

A further object of the invention is to provide an improved heat exchanger assembly for ultra-large radiators wherein the assembly utilizes automotive-type CAB (controlled atmosphere brazing) plastic tank aluminum core radiators instead of conventional copper/brass radiator core construction.

It is yet another object of the present invention to provide an improved heat exchanger assembly for ultra-large radiators wherein the assembly includes resilient tube-to-header joints required for protection against transportation shock and vibration.

Still other objects and advantages of the invention will in part be obvious and will in part be apparent from the specification.

The above and other objects, which will be apparent to those skilled in the art, are achieved in the present invention which is directed to, in a first aspect, a heat exchanger assembly comprising at least two heat exchanger cores arranged in parallel flow, each heat exchanger core including a plurality of tubes, fins between the tubes and opposing headers sealingly attached at each end of the tubes. The assembly comprises a common tank between the at least two heat exchanger cores, the common tank connected to a header at one end of each heat exchanger core, and separate tanks connected to a header at the other end of each of the at least two heat exchanger cores. The separate tanks may be inlet tanks for fluid passing into the heat exchanger assembly and the common tank may be an outlet tank for fluid passing out of the heat exchanger assembly, or the flow path may be reversed, with the common tank being an inlet tank and the separate tanks being outlet tanks.

The common tank may be centered between the at least two heat exchanger cores, and each of the at least two heat exchanger cores may have the same dimensions. The heat exchanger assembly may include a plurality of heat exchanger cores and there may be the same number of heat exchanger cores on each side of the common tank.

Each of the heat exchanger cores may be a copper/brass core, wherein the common tank and separate tanks are comprised of steel, the headers are each comprised of brass, and the heat exchanger cores comprise brass tubes and copper or copper alloy fins.

The heat exchanger assembly may include a pair of opposing side members adapted to provide structural support to the heat exchanger cores and to substantially eliminate air flow bypass around the side of the cores. The heat exchanger cores may be arranged in pairs and the heat exchanger assembly may further include a core support member disposed between each pair of heat exchanger cores and shaped to force entering air to either side of the core support member and direct air flow to the fins and tubes of the heat exchanger cores. The core support member may have a length corresponding to a length of the heat exchanger cores, and a width corresponding to a depth of the heat exchanger cores.

Each tube may have a tube end sealingly inserted into one of a plurality of openings in the header to form a resilient tube-to-header joint.

In another aspect, the present invention is directed to a heat exchanger assembly, comprising at least two heat exchangers arranged in parallel flow, each heat exchanger including a plurality of tubes, fins between the tubes, opposing headers sealingly attached at each end of the tubes, and inlet and outlet tanks sealingly attached to the headers. The assembly comprises a common tank between the at least two heat exchangers, the common tank connected to a tank at one end of each heat exchanger, and separate tanks connected to a tank at the other end of each of the at least two heat exchangers. The separate tanks may be inlet tanks for fluid passing into the heat exchanger assembly and the common tank may be an outlet tank for fluid passing out of the heat exchanger assembly, or the flow path may be reversed, with the common tank being an inlet tank and the separate tanks being outlet tanks.

Each of the heat exchangers may be sealingly connected to the common and separate tanks using at least one hose attached between the tank on one end of each heat exchanger and the common tank, and the tank on the other end of each heat exchanger and one of the separate tanks, respectively.

The common tank may be centered between the at least two heat exchangers, and each of the at least two heat exchangers may have the same dimensions. The heat exchanger assembly may include a plurality of heat exchangers and there may be the same number of heat exchangers on each side of the common tank.

The common tank and separate tanks may each be comprised of steel, and each of the heat exchangers may comprise a CAB aluminum core, wherein the tanks are comprised of plastic, and the cores comprise aluminum tubes, fins and headers.

The heat exchanger assembly may include a pair of opposing side members adapted to provide structural support to the heat exchangers and to substantially eliminate air flow bypass around the side of the heat exchangers. The heat exchangers may be arranged in pairs and the heat exchanger assembly may further include a support member disposed between each pair of heat exchangers and shaped to force entering air to either side of the support member and direct air flow to the fins and tubes of the heat exchangers. The support member may have a length corresponding to a length of the heat exchangers, and a width corresponding to a depth of the heat exchangers.

Each tube may have a tube end sealingly inserted into one of a plurality of openings in the header to form a resilient tube-to-header joint.

In yet another aspect, the present invention is directed to a method of operating a heat exchanger. The method comprises the steps of providing at least two heat exchanger cores arranged in parallel flow, each heat exchanger core including a plurality of tubes, fins between the tubes and opposing headers sealingly attached at each end of the tubes; providing a common tank between the at least two heat exchanger cores, the common tank connected to a header at one end of each heat exchanger core; and providing separate tanks connected to a header at the other end of each of the at least two heat exchanger cores. The method further comprises providing fluid ports on each of the common tank and the separate tanks for passage of a fluid into and out of the heat exchanger, whereby one of the common tank or the separate tanks is an outlet tank for fluid passing out of the heat exchanger and the other of the common tank or the separate tanks is an inlet tank for fluid passing into the heat exchanger; and flowing the fluid between the common tank and the separate tanks through the at least two heat exchanger cores to cool the fluid.

The method may include providing each of the separate tanks with an inlet fluid port and the common tank with an outlet fluid port. In at least one method, the step of flowing the fluid between the common tank and the separate tanks comprises first flowing the fluid through the separate tank inlet fluid ports, through the at least two heat exchanger cores, and then through the common tank outlet fluid port.

The method may further comprise the step of connecting an inlet fluid line to a fluid port on one of the common tank and the separate tanks, and connecting an outlet fluid line to a fluid port on the other of the common tank and the separate tanks.

In still yet another aspect, the present invention is directed to a tank for a heat exchanger assembly, the tank positioned between at least two heat exchanger cores each including a plurality of tubes, fins between the tubes and opposing headers sealingly attached at each end of the tubes, the tank connected to a header at one end of each heat exchanger core and including a fluid port for passage of a fluid into or out of the heat exchanger assembly. The at least two heat exchanger cores may be arranged in parallel flow, and the fluid may be flowed between the common tank and a pair of opposing separate tanks connected to a header at the other end of each of the at least two heat exchanger cores through the at least two heat exchanger cores to cool the fluid.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
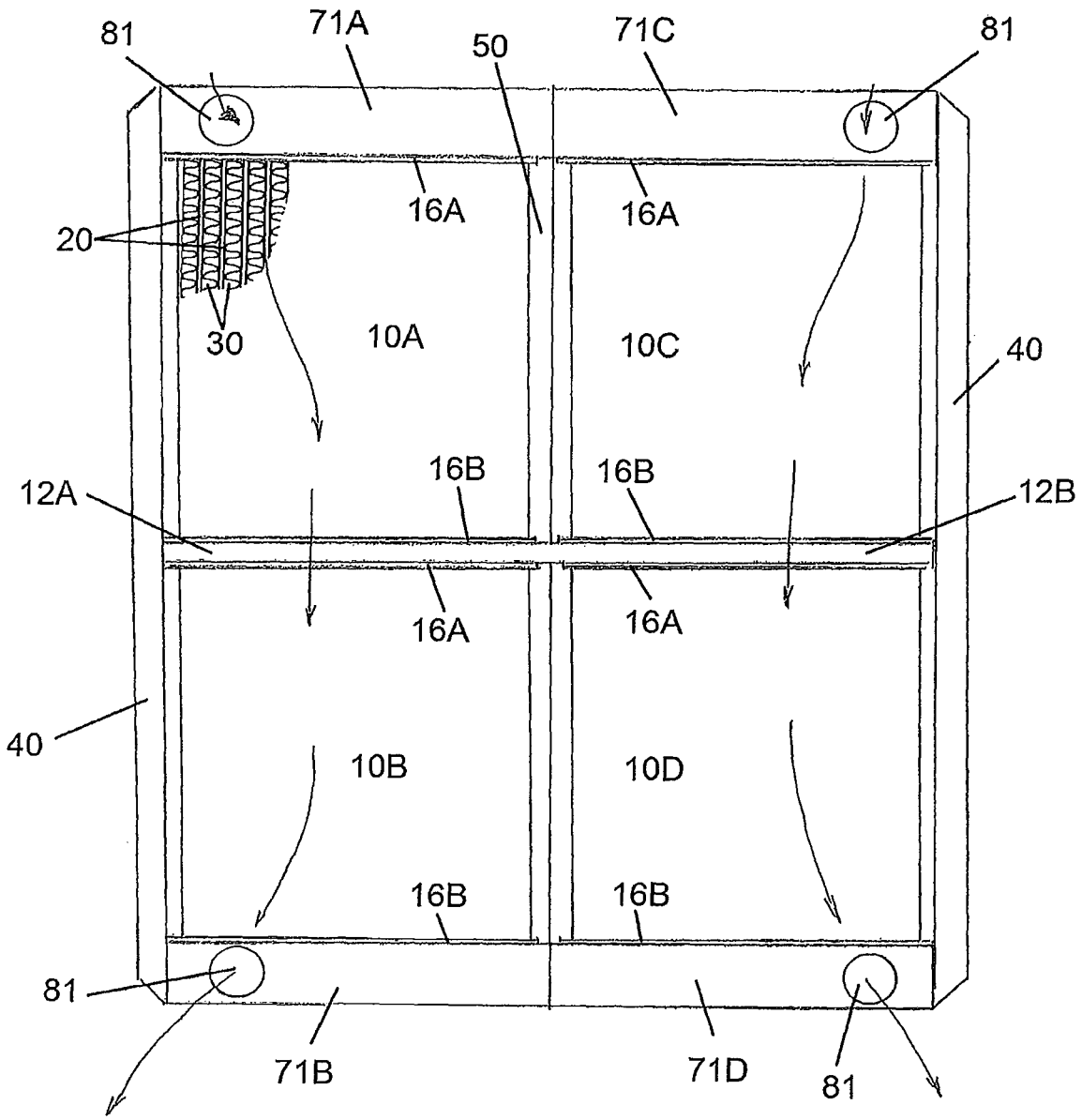
FIG. 1 (PRIOR ART)
FIG. 1 depicts a front elevational view of a typical modular heat exchanger assembly of the prior art, with a partial cutaway of a radiator core showing core tubes and cooling fins therebetween and the direction of coolant flow through the assembly.

In describing the embodiments of the present invention, reference will be made herein to FIGS. 1-6 of the drawings in which like numerals refer to like features of the invention.

The present invention is directed to a unique assembly of radiator cores which cut the length of the coolant flow path by half by having the coolant enter the radiator through two side inlet tanks and flow horizontally through two (or more) radiator cores in parallel to a center outlet tank. With the pressure drop thus reduced, the radiator cores may now be made with fewer rows of tubes deep, thereby making the cores thinner and less expensive.

Certain terminology is used herein for convenience only and is not to be taken as a limitation of the invention. For example, words such as "upper," "lower," "left," "right," "horizontal," "vertical," "upward," and "downward" merely describe the configuration shown in the drawings. For purposes of clarity, the same reference numbers may be used in the drawings to identify similar elements.

Referring now to FIG. 1, a typical modular heat exchanger assembly of the prior art is shown. The modular heat exchanger includes a plurality of radiator or other heat exchanger cores 10 integrally connected to a plurality of radiator tanks 71. Tanks 71A and 71C may be a single inlet tank and tanks 71B and 71D may be a single outlet tank. The cores include parallel vertical tubes 20 and fins 30 between the tubes for increased heat exchange efficiency, and may be CAB (controlled atmosphere brazing) aluminum cores. The cores 10 each include a first header 16A at the top end of the core and a second header 16B at the bottom end of the core. The modular heat exchanger shown includes four identical cores 10A, 10B, 10C, 10D. Vertically adjacent cores 10A, 10B are connected such that the bottom header 16B of core 10A is sealingly connected with the top header 16A of core 10B using a filler frame or connector member 12A. Likewise, vertically adjacent cores 10C, 10D are connected using a similar filler frame or connector member 12B secured between bottom header 16B of core 10C and top header 16A of core 10D. The filler frame or connector member 12A, 12B is an elongated member having a length approximately equal to the width of the cores and a width approximately equal to the depth of the cores. The length of the filler frame is typically greater than the width. An opening on the top and bottom of filler frame member 12A, 12B permits passage of coolant between the vertically connected cores, and the filler frame member may include a laterally outwardly extending top foot or lip and a laterally outwardly extending bottom foot or lip along the perimeter of each of the openings to permit the filler frame member to be sealingly secured with gaskets to the headers of each of the cores. The filler frame members may be made of any suitable material, for example steel.

Each heat exchanger header 16A, 16B, 16C, 16D may be sealingly connected with a gasket to the filler frame 12 or the tank 71 in accordance with known methods such as bolting.

The modular heat exchanger assembly of the prior art further includes upper radiator or coolant tanks 71A, 71C sealingly connected to the top header 16A of cores 10A, 10C, respectively, and lower radiator or coolant tanks 71B, 71D sealingly connected to the bottom header 16B of cores 10B, 10D, respectively. The tanks 71 each have an inlet/outlet 81 for connection to an internal combustion engine or other external system. Tanks 71 may be made of any suitable material, such as steel. Structural side members 40 are provided and are disposed adjacent heat exchanger cores along the left and right side of the modular heat exchanger and are used to protect and support the core sides and to substantially eliminate air flow bypass around the sides of the cores. An elongated core support member 50 performs a similar task as the structural side members 40 and extends between upper and lower headers of the cores.

Typically, coolant enters the top inlet tanks 71A, 71C and flows down through the two upper radiator cores 10A, 10C in parallel, through the filler frame or connector member 12A, 12B, and finally through the two lower radiator cores 10B, 10D in parallel to the outlet tanks 71B, 71D. The upper and lower radiator cores form a series flow path, that is, coolant flows first through the upper cores and then through the lower cores, with attendant pressure drops. The coolant flow rate needed to cool such large engines is so high that typically the radiators are made many more rows of tubes deep than are needed for cooling, just to be able to pass the high coolant flows without excessive pressure drop.

U.S. Pat. No. 8,631,859, entitled "Modular Heat Exchanger", shows in FIG. 9 a modular heat exchanger assembly made up of CAB aluminum radiator cores crimped to plastic tanks which are, in turn, sealingly connected to metal heat exchanger assembly tanks. It also shows, in FIG. 2, a modular heat exchanger assembly made up of CAB aluminum radiator cores crimped to plastic heat exchanger assembly tanks. In both cases, fluid flows in series, with high attendant pressure drop, first through the upper radiator cores and then through the lower radiator cores. The modular heat exchanger assembly of the present invention remedies this deficiency by reducing the coolant flow path by half, thereby reducing the coolant pressure drop and allowing the radiator cores to be made thinner, with fewer rows of tubes deep, for the same coolant pressure drop. This reduction in core depth will result in significant manufacturing time and cost savings.

Figure 2:
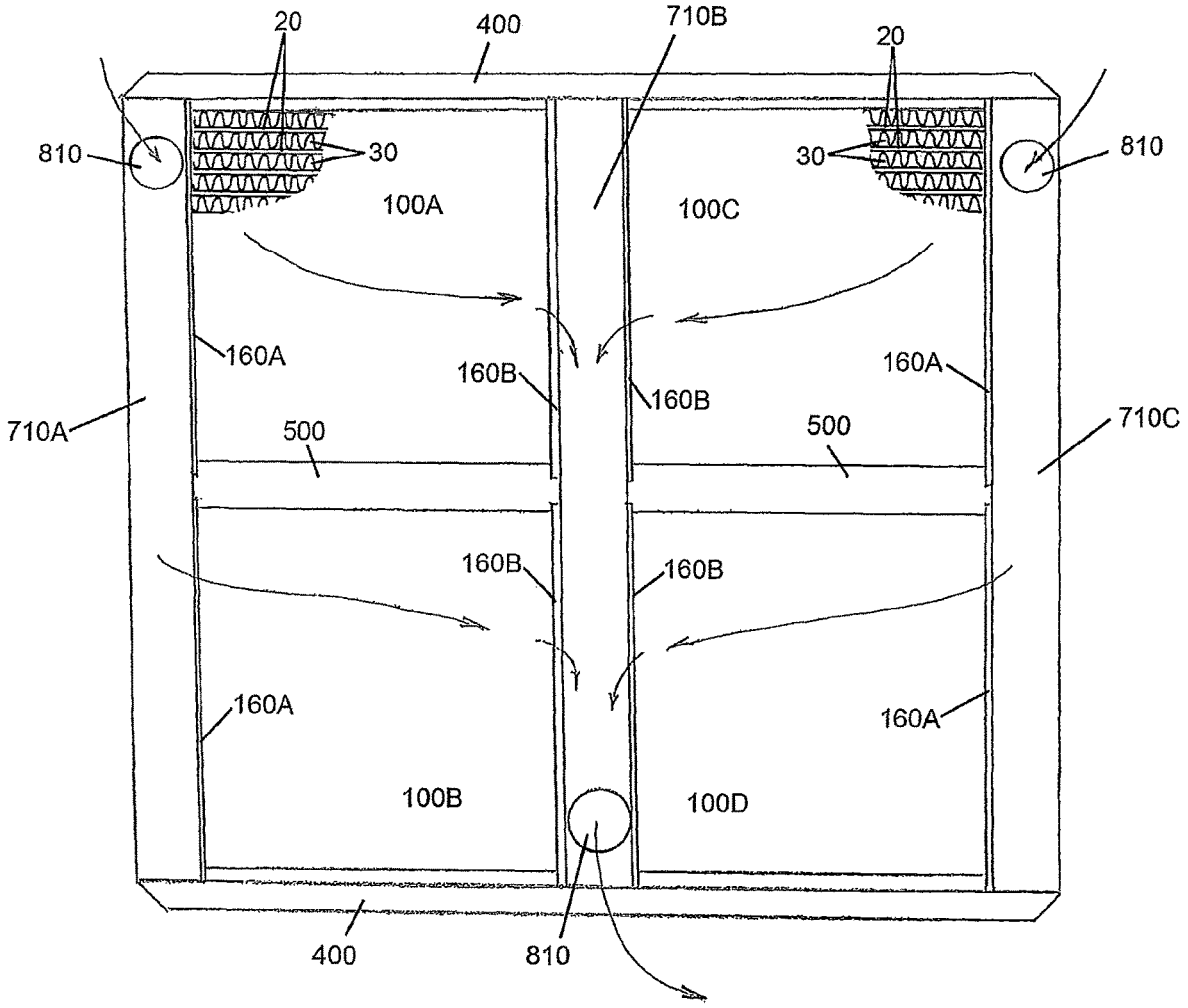
FIG. 2 depicts a front elevational view of one embodiment of a modular heat exchanger assembly according to the present invention.

Referring now to FIG. 2, one embodiment of the modular heat exchanger assembly of the present invention is shown. The modular heat exchanger includes at least two radiator or other heat exchanger cores 100 arranged in parallel flow and integrally connected to a plurality of radiator tanks 710. For clarity, cooling air bypass shields and mounting structure have been omitted in all Figures. The cores include a plurality of parallel tubes 20 and fins 30 between the tubes for increased heat exchange efficiency, and may be comprised of conventional copper/brass soldered construction, copper/brass brazed construction (CuproBraze) or CAB (controlled atmosphere brazing) aluminum construction. As shown in FIG. 2, the cores are comprised of conventional copper/brass soldered construction, as described above. The cores 100 each include a first header 160A sealingly attached at one end of the core tubes and a second header 1608 sealingly attached at the opposite end of the core tubes. Each header 160A may be an inlet header for passage of coolant into the modular heat exchanger assembly, and the cores may be positioned such that coolant will flow through the core tubes in a horizontal direction between the headers 160A, 160B.

The modular heat exchanger shown in FIG. 2 includes four identically-dimensioned cores 100A, 100B, 100C, 100D. Vertically adjacent cores 100A, 100B are separated by a core support member 500 disposed therebetween. Support member 500 is used to protect and support the core sides and to substantially eliminate air flow bypass around the sides of the cores. Likewise, vertically adjacent cores 100C, 100D are connected using a similar core support member 500 disposed between cores 100C, 100D. The core support member 500 is an elongated member having a length approximately equal to the length of the cores and a width (in the direction of air flow, into the Figure) approximately equal to the depth of the cores. The core support members may be made of any suitable material, for example steel or aluminum, and are shaped to force entering air to either side of the core support member and direct air flow to the fins and tubes of the heat exchanger cores.

The modular heat exchanger assembly of the present invention includes separate radiator or coolant tanks 710A, 710C on either side of the assembly sealingly connected to the first headers 160A of cores 100A, 100B, 100C, 100D, respectively, and a common tank 710B disposed between and sealingly connected to the second headers 160B of cores 100A, 100B, 100C, 100D, respectively. Common tank 710B may be centered between one or more pairs of horizontally adjacent cores, as shown in FIG. 2. The tanks 710 each have an inlet/outlet for connection to an internal combustion engine or other external system.

Inlet/outlet fluid ports 810 are provided on each of the common tank 710B and the separate tanks 710A, 710C for passage of fluid into and out of the heat exchanger. In an embodiment, the separate tanks may be inlet tanks for fluid passing into the heat exchanger assembly and the common tank may be an outlet tank for fluid passing out of the heat exchanger assembly, or the flow path may be reversed, with the common tank being an inlet tank and the separate tanks being outlet tanks. In operation, fluid enters the assembly through inlet ports in either the common tank or separate tanks, and the fluid flows between the common tank and the separate tanks, respectively, through the at least two heat exchanger cores to cool the fluid. By cutting the length of the coolant flow path in half over that of the conventional prior art modular assembly, the coolant pressure drop is reduced, allowing the radiator cores to be made thinner, with fewer rows of tubes deep, for the same coolant pressure drop. In certain embodiments, the radiator cores may be as few as a single row of tubes deep depending on design requirements.

As shown in FIG. 2, in at least one embodiment, heated coolant enters the heat exchanger assembly through inlet fluid ports 810 in side, opposing coolant tanks 710A, 710C and flows horizontally in parallel flow through a plurality of tubes in the horizontally adjacent radiator cores to a center, common outlet tank 710B which includes an outlet fluid port 810. Coolant does not flow through core support member 500. It should be understood by those skilled in the art that in accordance with the objects of the present invention, in alternate embodiments the direction of coolant flow may be reversed, e.g. the common tank 710B may be an inlet tank and the side tanks 710A, 710C may be outlet tanks. Tanks 710 may be made of any suitable material, such as steel. Structural side members 400 are provided and are disposed adjacent the heat exchanger cores along the sides of the modular heat exchanger assembly which do not include coolant tanks and are used to protect and support the core sides, provide for mounting attachments, and to substantially eliminate air flow bypass around the sides of the cores.

Figure 5:
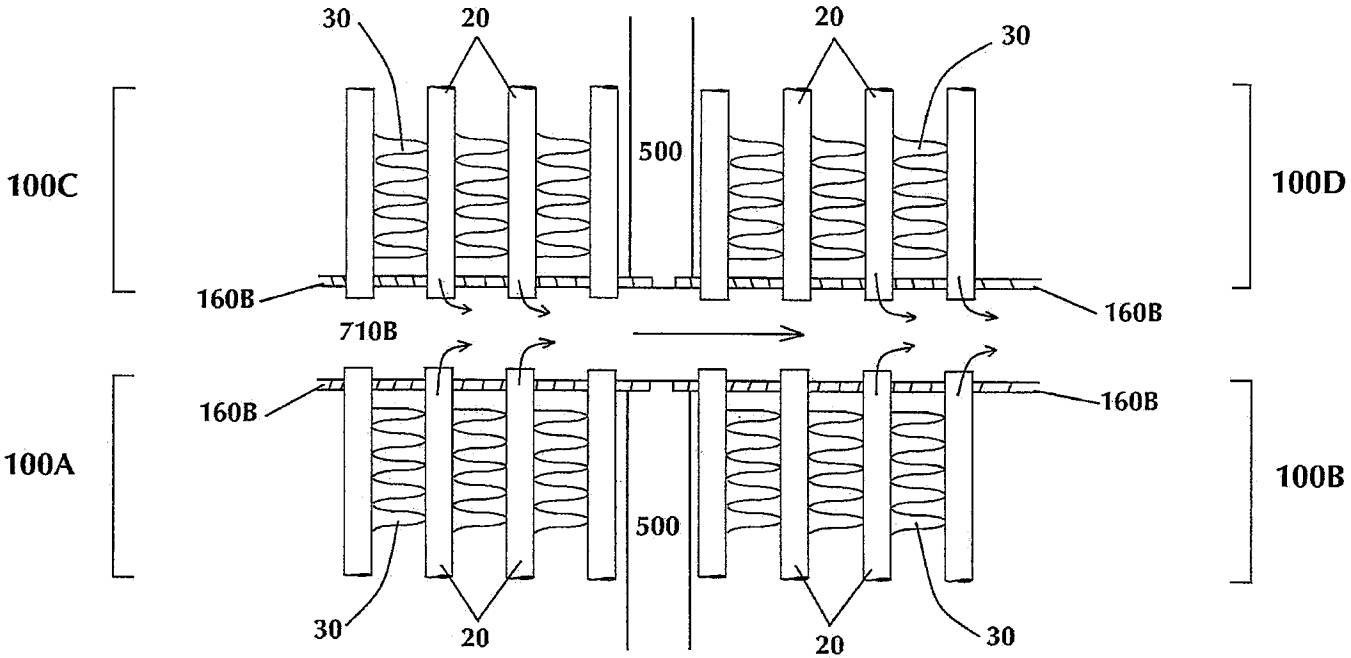
FIG. 5 depicts a cutaway view of a segment of a modular heat exchanger assembly according to the present invention shown in FIG. 2, showing heat exchanger core fins and tubes secured in headers on either side of a common tank, with a core support member disposed between vertically adjacent cores.

FIG. 5 depicts a cutaway view of a segment of an embodiment of the modular heat exchanger assembly of the present invention shown in FIG. 2, showing heat exchanger core fins and tubes secured in headers on either side of a common tank, with a core support member disposed between vertically adjacent cores. As shown in FIG. 5, a common tank 710B is centered between horizontally adjacent cores 100A, 100C and 100B, 100D, respectively. Tank 710B may be an outlet tank and may include a plurality of integral outlet headers 160B on either side of the tank. A plurality of core tubes 20 are secured in openings in the header 160B wall, with fins 30 positioned between the tubes for increased heat exchange efficiency. Coolant flows in a parallel flow between the separate tanks (not shown) and the common tank 710B through the heat exchanger cores 100A, 1006, 100C, 100D to cool the coolant.

As shown in FIG. 5, in at least one embodiment, heated coolant flows horizontally through the plurality of tubes 20 in each core in parallel flow, through outlet headers 1606 and into outlet tank 710B before exiting the tank through an outlet fluid port (not shown). Core support member 500 is disposed between vertically adjacent cores 100A, 100B and 100C, 100D, respectively, and is shaped to force entering air to either side of the core support member and direct air flow to the fins and tubes of the heat exchanger cores. Coolant does not pass through the core support member 500.

The modular assembly of the present invention may be applied to any type of radiator core construction, including the conventional large, multi-cored copper/brass core assembly construction, as shown in FIG. 2. However, such a large core assembly of copper/brass material is expensive for two reasons. First, the price of copper and copper-based alloys is expensive and, second, the manufacturing methods associated with soldered or brazed copper/brass radiator construction are labor-intensive.

Automobile and light truck, and some heavy truck, radiators have long since abandoned costly copper/brass radiator construction in favor of CAB (controlled atmosphere brazing) aluminum core construction with plastic tanks. PTA (plastic tank aluminum) radiators have tabbed aluminum headers which are crimped to a plastic radiator tank with an elastomeric gasket between. This type of construction is more automated, requires far less labor, is more consistent, uses less costly material, and results in a product which is lighter, stronger and which has demonstrated improved durability compared to soldered copper/brass. However, the available CAB furnaces limit core size to not larger than about 48 inches square.

Figure 3:
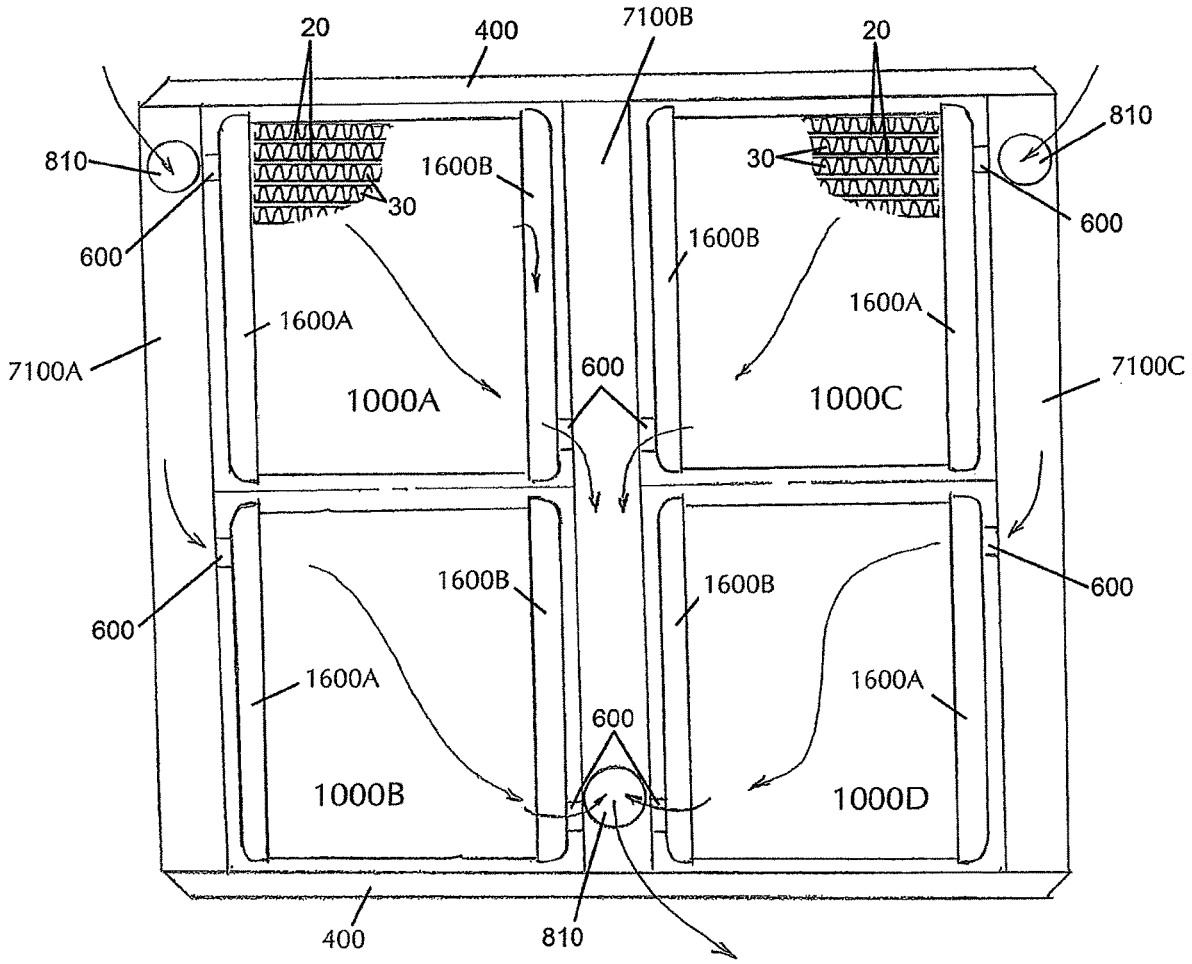
FIG. 3 depicts a front elevational view of another embodiment of a modular heat exchanger assembly according to the present invention, wherein the radiator cores are automotive-type plastic tank aluminum radiators.
Figure 4A:
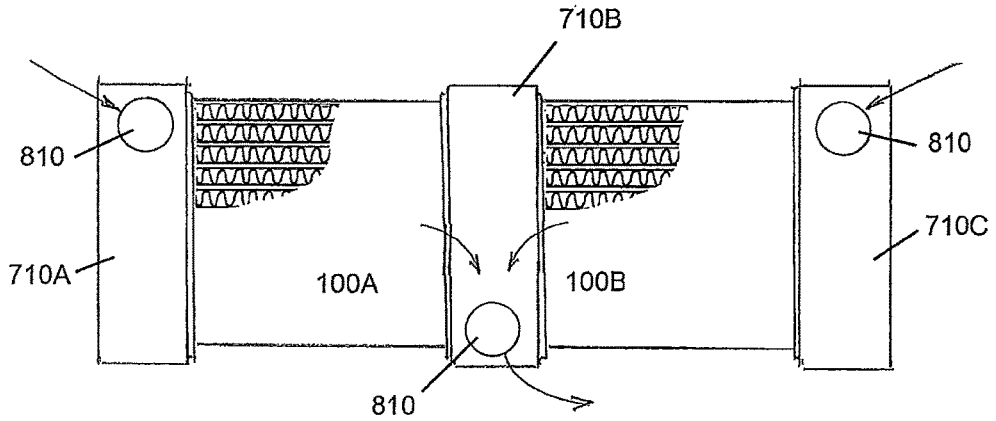
FIG. 4A depicts a front elevational view of an embodiment of the present invention wherein the modular heat exchanger assembly includes a pair of radiator cores.
Figure 4B:
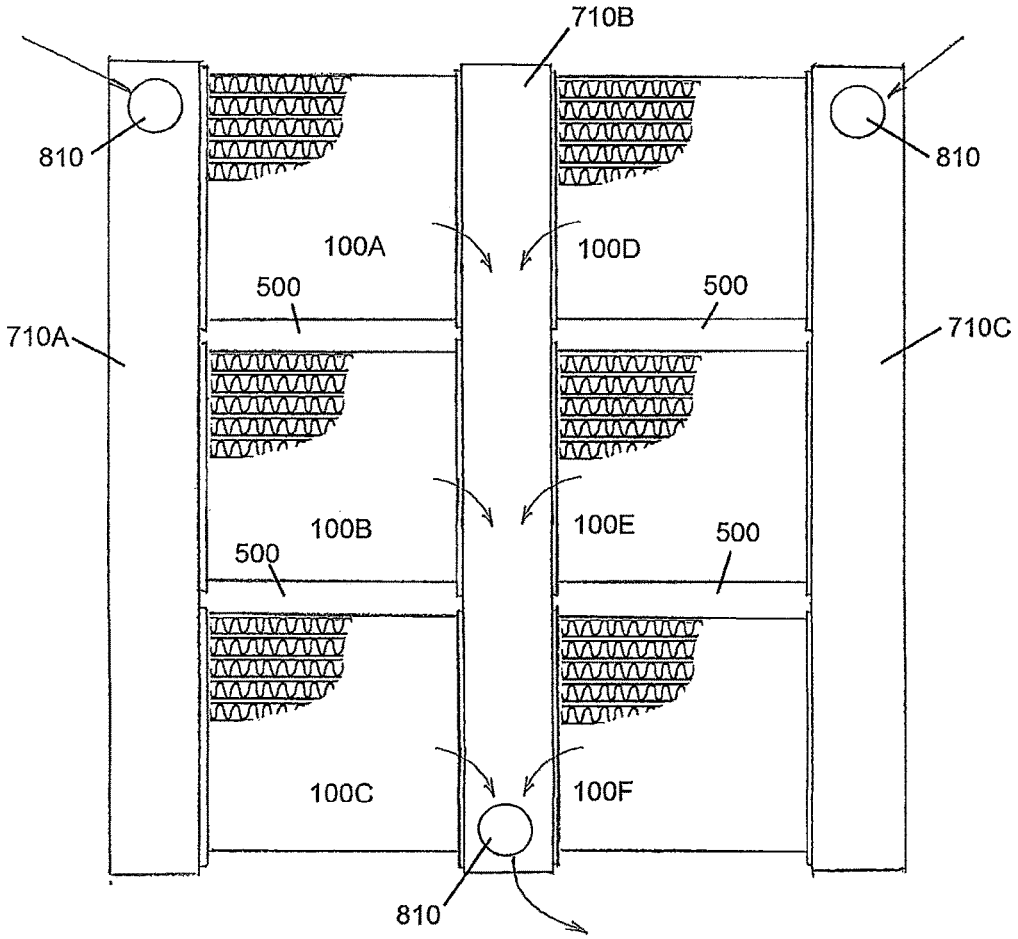
FIG. 4B depicts a front elevational view of an embodiment of the present invention wherein the modular heat exchanger assembly includes six radiator cores arranged in parallel flow.

Referring now to FIG. 3, another embodiment of the modular heat exchanger assembly of the present invention is shown, wherein the assembly utilizes modern automotive-type radiators of PTA (plastic tank aluminum) core construction, as opposed to a conventional copper/brass core assembly construction typically used in large industrial or vehicular radiators. FIG. 3 is a front elevational view of the assembled modular heat exchanger which includes a plurality of radiators or other heat exchangers 1000 of PTA core construction integrally connected to a plurality of steel tanks 7100 and arranged in a similar manner to the embodiment shown in FIG. 2. For clarity, cooling air bypass shields and mounting structure have been omitted. The individual inlet/outlet tanks 1600 of each radiator or heat exchanger are connected to side inlet tanks 7100A, 7100C and common outlet tank 7100B, respectively, by means of one or more hoses 600. As shown in FIG. 3, radiator tanks 1600A are inlet tanks including headers (not shown) for passage of fluid into the radiators, whereas radiator tanks 1600B are outlet tanks and include headers (not shown) for passage of fluid out of the radiators and into the radiator outlet tanks 7100B. As described above, in at least one embodiment, coolant enters the heat exchanger assembly through inlets 810 in side, opposing coolant tanks 7100A, 7100C, flows through the plurality of hoses 600 into radiator inlet tanks 1600A and then flows horizontally in parallel flow through a plurality of tubes 20 in horizontally adjacent radiators or heat exchangers 1000, through radiator outlet tanks 1600B to a common outlet tank 7100B by way of one or more hoses 600. Again, it should be understood by those skilled in the art that in accordance with the objects of the present invention the direction of coolant flow may be reversed. The headers (not shown) of each radiator or heat exchanger 1000 may be sealingly interconnected to the respective inlet/outlet tanks 1600.

In a typical PTA core construction, the core tubes and fins are made of aluminum or an aluminum alloy, and may be clad or coated with braze material, but other metals and alloys may also be used. The tubes are inserted into, and sealed to, openings in the walls of an aluminum inlet header and outlet header, respectively, to make up the core. The headers are connected to, or part of, plastic inlet and outlet tanks or manifolds and structural side pieces connect the tanks to complete the heat exchanger. Each of the tubes has a tube end secured in an opening in the header wall to form a tube-to-header joint. Oval tubes are typically utilized for close tube spacing for optimum heat transfer performance of the heat exchanger, although other tube shapes and cross-sections may be utilized. The tube-to-header joint is typically brazed to prevent leakage around the tubes and header.

Rigid tube-to-header joints pose several problems in the field of ultra-large heat exchangers, for example, while stationary generator sets are not subject to transportation shock and vibration, earth movers and locomotives certainly are. This transportation shock and/or vibration can lead to failure at the tube-to-header joint, destroying the radiator core. Moreover, the cooling systems of some locomotives consist of multiple large radiators which are connected into the system by valving on an "on demand" basis. As a result, when running in cold weather on level grade, only two of up to six available radiators might be connected. Then, when climbing a grade, one or more of the other radiators would be connected in order to handle the cooling load. The result is that some radiators would be lying idle at winter ambient temperatures well below freezing when, suddenly, they would be shocked with hot coolant around 190 degrees Fahrenheit. Such a thermal shock would destroy the average radiator core; therefore, resilient tube-to-header joints to absorb the expansion/contraction of the core tubes are essential.

Figure 6:
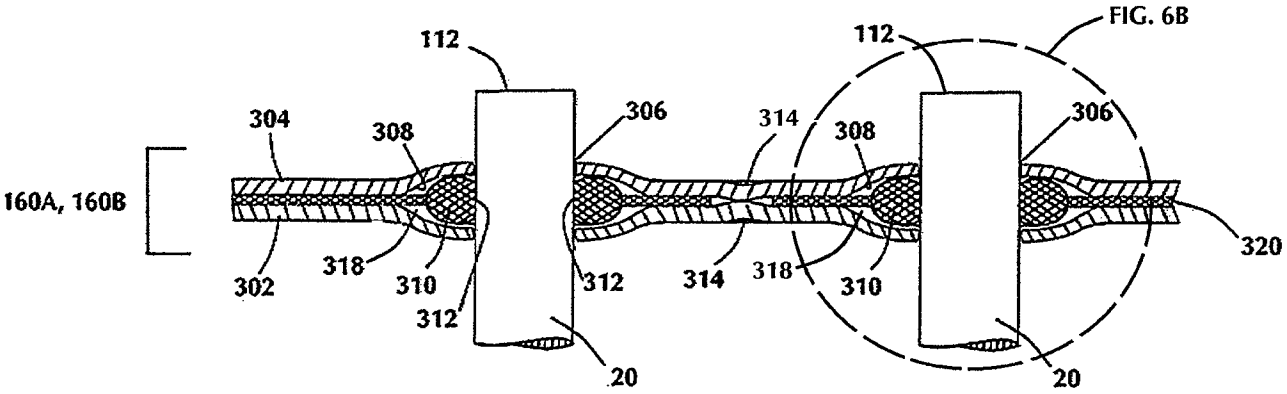
FIG. 6 depicts a cross-sectional view of a segment of an exemplary header according to an embodiment of the present invention, wherein each tube-to-header joint is sealed with a resilient O-ring seal.
Figure 6B:
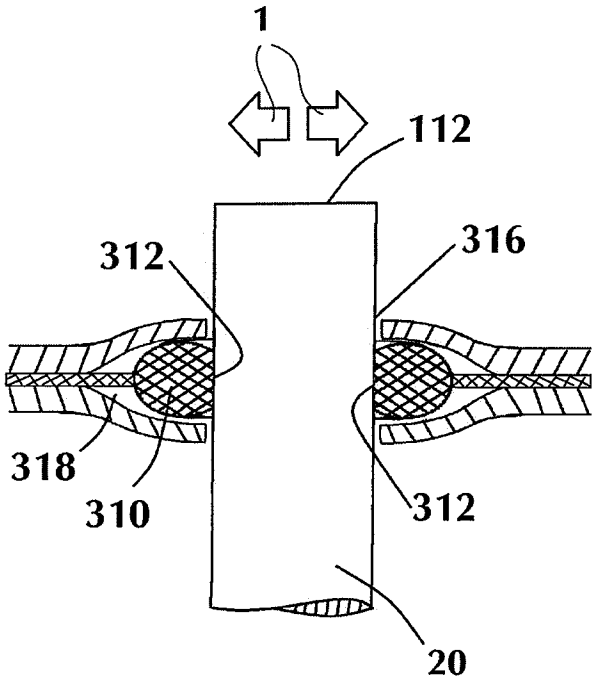
FIGS. 6A to 6B depict isolated views of one tube-to-header joint as shown in FIG. 6, showing a portion of the tube disposed within one of the plurality of O-rings prior to (FIG. 6A), and subsequent to (FIG. 6B), tube expansion outwardly to form the O-ring seal.
Figure 6A:
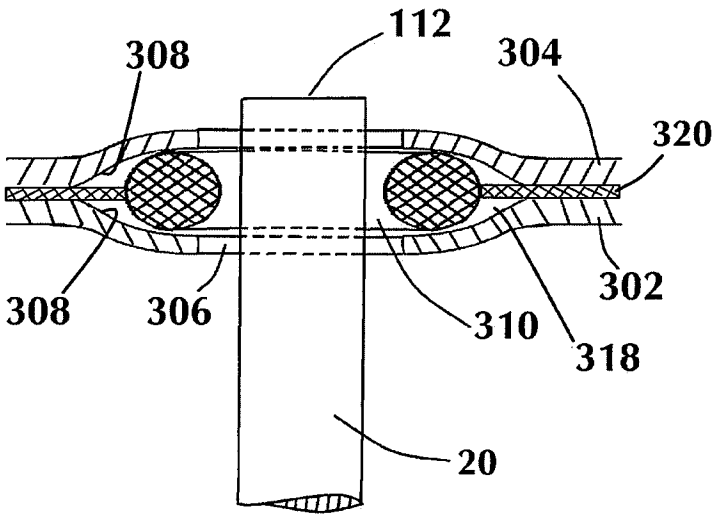

The modular heat exchanger assembly of the present invention remedies these deficiencies by, in at least one embodiment, utilizing a resilient O-ring seal which does not require brazing at the tube-to-header joint and allows for relative motion between the tube and header without the build-up of high stresses. FIG. 6 depicts a cross-sectional view of a segment of an exemplary header according to an embodiment of the present invention, wherein each tube-to-header joint is sealed with a resilient O-ring seal. As shown in FIG. 6, in at least one embodiment, each header 160A, 160B may be comprised of producing by stamping two mating header plates 302, 304. Each header plate includes a plurality of clearance holes 306 for heat exchanger core tubes 20 to pass through, and around each clearance hole is a continuous depression 308 forming one half of an O-ring groove 318. O-rings 310 are assembled into these depressions, and the mating header plate is placed on top of the lower plate and secured, such as by spot-welding at location 314, thereby trapping the O-rings in their O-ring grooves 318. As shown in FIG. 6, the O-rings 310 are assembled in a thin sheet 320 which is sealed between the mating header plates 302, 304 during assembly of the header 160A, 1608. In other embodiments, the O-rings may be assembled to the header plate 302 individually, rather than in one or more O-ring sheets. The assembled header 160A, 160B is then slid over the tube ends 112 of the heat exchanger core 100A, 100B, 100C, 100D to its required location, either manually or through automation. After the header is fitted over the tube ends, the tubes 20 are then expanded outwardly in the direction of arrows 1, such as by use of a mandrel, to provide the necessary O-ring deformation required to obtain a seal 312, without contacting either of the first or second header plate, as shown in the transition from FIG. 6A (prior to tube expansion) to FIG. 6B (after tube expansion). The proper compression of the O-ring seal is provided by expanding the tubes after assembly of the header 160A, 160B to the core tubes 20, thus eliminating the requirement for close tolerances of the O-ring groove 318. In service, the resiliency of the O-ring seal 312 allows for linear expansion and contraction of the tubes without the build-up of high stresses at the tube-to-header joint. The connection and method for connection of such tube-to-header joints are also described in U.S. patent application Ser. No. 14/844,553 entitled "Heat Exchanger Tube-to-Header Sealing System", the disclosure of which is hereby incorporated by reference. The assembled headers 160 may then be sealingly interconnected to the coolant tanks 710, as shown in FIG. 2. This resilient tube-to-header sealing system may also be used with the PTA (plastic tank aluminum) heat exchanger construction shown in FIG. 3.

The modular heat exchanger assembly according to the present invention is applicable to many types of ultra-large air-cooled heat exchangers, such as radiators, charge air coolers and air cooled oil coolers, for use in vehicles or industry. The assembly may include any number of heat exchanger cores arranged in parallel flow. The cores shown in FIGS. 2 and 3 are in a 2×2 row and column arrangement. If each core were 36 in. (0.91 m) high×36 in. (0.91 m) wide, the final modular heat exchanger assembly would be about 72 in. (1.83 m) high (plus the height of the side support members and center core support member)×72 in. (1.83 m) wide (plus the width of the inlet tanks and common outlet tank). It should be understood by those in the art that additional rows or columns may be provided, as in 1×2 (FIG. 4A), 3×2 (FIG. 4B), 4×2 or more arrangements to use smaller individual core sizes, or to create larger modular cores.

Thus the present invention achieves one or more of the following advantages. The present invention provides an improved modular heat exchanger assembly which reduces the coolant flow path length by half, thereby reducing coolant pressure drop and allowing the radiator cores to be made thinner, with fewer rows of tubes deep, for the same coolant pressure drop. The assembly is applicable to all types of heat exchanger core construction, and can provide significant cost reductions over conventional practice by utilizing automotive-type PTA core radiators connected in parallel to inlet side tanks and a center outlet tank by means of hoses. The assembly may include resilient tube-to-header joints which will provide protection against thermal shock in some locomotive and other radiator applications, at a greatly reduced cost. The assembly can also be applied to various ultra-large heat exchangers, such as radiators, charge air coolers and air cooled oil coolers.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A modular heat exchanger assembly, comprising:

at least two heat exchangers arranged in parallel flow, each heat exchanger including a plurality of tubes, fins between the tubes, opposing headers sealingly attached at each end of the tubes, and inlet and outlet tanks sealingly attached to the opposing headers, each opposing header comprising first and second mating header plates secured together and having a plurality of mating openings therein and a plurality of O-rings trapped within O-ring grooves formed by continuous depressions around a circumference of each of the plurality of mating openings, a portion of each tube being disposed within one of the plurality of O-rings and said portion being expanded outwardly to form a seal at each tube-to-header joint without contacting either of the first or second header plate, whereby the second header plate is in direct contact with and secured to the first header plate at at least one point between adjacent O-rings such that the first header plate plurality of openings are aligned with the second header plate plurality of openings trapping each of the plurality of O-rings in the O-ring grooves;

a common tank between the at least two heat exchangers, the common tank connected to one of the inlet tank or outlet tank, respectively, at one end of each heat exchanger; and separate tanks connected to the other of the inlet tank or outlet tank, respectively, at the other end of each of the at least two heat exchangers, whereby one of the common tank or the separate tanks is an outlet tank or tanks for fluid passing out of the modular heat exchanger assembly and the other of the common tank or the separate tanks is an inlet tank or tanks for fluid passing into the modular heat exchanger assembly.

2. The heat exchanger of claim 1 wherein the heat exchangers are sealingly connected to the common and separate tanks, respectively, using at least one hose attached between the tank on one end of each heat exchanger and the common tank, and the tank on the other end of each heat exchanger and one of the separate tanks, respectively.

3. The heat exchanger assembly of claim 1 wherein the common tank is centered between the at least two heat exchangers.

4. The heat exchanger assembly of claim 1 including a plurality of heat exchangers and wherein there are the same number of heat exchangers on each side of the common tank.

5. The heat exchanger assembly of claim 3 wherein the common tank and separate tanks are each comprised of steel and each of the heat exchangers comprises a CAB aluminum core wherein the tanks are comprised of plastic and the cores are comprised of aluminum tubes, fins and headers.

6. The heat exchanger assembly of claim 3 including a pair of opposing side members adapted to provide structural support to the heat exchangers and to at least partially eliminate air flow bypass around each side of the heat exchangers.

7. The heat exchanger assembly of claim 3 wherein the heat exchangers are arranged in pairs and further including a support member disposed between each pair of heat exchangers and shaped to force entering air to either side of the support member and direct air flow to the fins and tubes of the heat exchangers.

8. The heat exchanger assembly of claim 3 wherein each tube has a tube end sealingly inserted into one of a plurality of openings in the header to form a resilient tube-to-header joint.

9. A method of operating a modular heat exchanger assembly, comprising the steps of:

providing at least two heat exchangers arranged in parallel flow, each heat exchanger including a plurality of tubes, fins between the tubes, opposing headers sealingly attached at each end of the tubes, and inlet and outlet tanks sealingly attached to the opposing headers, each opposing header comprising first and second mating header plates secured together and having a plurality of mating openings therein and a plurality of O-rings trapped within O-ring grooves formed by continuous depressions around a circumference of each of the plurality of mating openings, a portion of each tube being disposed within one of the plurality of O-rings and said portion being expanded outwardly to form a seal at each tube-to-header joint without contacting either of the first or second header plate, whereby the second header plate is in direct contact with and secured to the first header plate at at least one point between adjacent O-rings such that the first header plate plurality of openings are aligned with the second header plate plurality of openings trapping each of the plurality of O-rings in the O-ring grooves;

providing a common tank between the at least two heat exchangers, the common tank connected to one of the inlet tank or outlet tank, respectively, at one end of each heat exchanger;

providing separate tanks connected to the other of the inlet tank or outlet tank, respectively, at the other end of each of the at least two heat exchangers;

providing fluid ports on each of the common tank and the separate tanks for passage of a fluid into and out of the heat exchanger assembly, whereby one of the common tank or the separate tanks is an outlet tank or tanks for fluid passing out of the heat exchanger assembly and the other of the common tank or the separate tanks is an inlet tank or tanks for fluid passing into the heat exchanger assembly; and flowing the fluid between the common tank and the separate tanks through the at least two heat exchangers to cool the fluid.

10. The method of claim 9 further comprising the step of:

sealingly connecting each heat exchanger to the common and separate tanks, respectively, using at least one hose attached between the inlet or outlet tank, respectively, on one end of each heat exchanger and the common tank, and the other of the inlet or outlet tank, respectively, on the other end of each heat exchanger and one of the separate tanks.

11. The method of claim 9 wherein each of the separate tanks includes an inlet fluid port of the fluid ports and the common tank includes an outlet fluid port of the fluid ports, and wherein the step of flowing the fluid between the common tank and the separate tanks comprises first flowing the fluid through the separate tank inlet fluid ports, through the at least two heat exchangers in parallel, and then through the common tank outlet fluid port.

12. The method of claim 9 further comprising the step of:

connecting an inlet fluid line to an inlet fluid port of the fluid ports on one of the common tank and the separate tanks, and connecting an outlet fluid line to an outlet fluid port of the fluid ports on the other of the common tank and the separate tanks.

13. A modular heat exchanger assembly, comprising:

at least two heat exchangers arranged in parallel flow, each heat exchanger including a plurality of tubes, fins between the tubes, opposing headers sealingly attached at each end of the tubes, and inlet and outlet tanks sealingly attached to the opposing headers, each opposing header comprising first and second mating header plates secured together and having a plurality of mating openings therein and a plurality of O-rings trapped within O-ring grooves formed by continuous depressions around a circumference of each of the plurality of mating openings, said O-ring grooves disposed between said first and second mating header plates and spaced along a length of said opposing header, a portion of each tube being disposed within one of the plurality of O-rings and said portion being expanded outwardly to form a seal at each tube-to-header joint without contacting either of the first or second header plate, whereby the second header plate is in direct contact with and secured to the first header plate at at least one point between adjacent O-rings such that the first header plate plurality of openings are aligned with the second header plate plurality of openings trapping each of the plurality of O-rings in the O-ring grooves;

a common tank between the at least two heat exchangers, the common tank connected to one of the inlet tank or outlet tank, respectively, at one end of each heat exchanger; and separate tanks connected to the other of the inlet tank or outlet tank, respectively, at the other end of each of the at least two heat exchangers, whereby one of the common tank or the separate tanks is an outlet tank or tanks for fluid passing out of the modular heat exchanger assembly and the other of the common tank or the separate tanks is an inlet tank or tanks for fluid passing into the modular heat exchanger assembly.

* * * * *